US007901483B2

(12) United States Patent
Spachner

(10) Patent No.: US 7,901,483 B2
(45) Date of Patent: Mar. 8, 2011

(54) PROCESS FOR RECOVERING TITANIUM

(75) Inventor: Sheldon A. Spachner, Media, PA (US)

(73) Assignee: Metals Production Research, Inc., Media, PA (US)

( * ) Notice: Subject to any disclaimer, the term of this patent is extended or adjusted under 35 U.S.C. 154(b) by 577 days.

(21) Appl. No.: 11/581,556

(22) Filed: Oct. 16, 2006

(65) Prior Publication Data

US 2008/0087139 A1 Apr. 17, 2008

(51) Int. Cl.
*C22B 34/00* (2006.01)

(52) U.S. Cl. ..... 75/619; 75/611; 75/612; 75/613; 75/614; 75/615; 75/616; 75/617; 75/618; 75/620

(58) Field of Classification Search ..... 75/330, 75/343, 345, 371, 392, 414, 585, 611–621, 75/709, 363–370, 10.18, 10.28; 205/334, 205/338, 354, 367, 397, 398, 402, 404; 204/193, 204/194, 242, 243.1, 245, 247
See application file for complete search history.

(56) References Cited

U.S. PATENT DOCUMENTS

| | | | | |
|---|---|---|---|---|
| 1,800,589 | A * | 4/1931 | Barstow et al. | 205/404 |
| 2,205,854 | A * | 6/1940 | Kroll | 75/617 |
| 2,783,195 | A * | 2/1957 | Raynes et. al. | 205/367 |
| 2,890,112 | A * | 6/1959 | Winter, Jr. | 75/619 |
| 2,891,857 | A * | 6/1959 | Eaton | 75/617 |
| 2,908,619 | A * | 10/1959 | Barnett | 205/399 |
| 3,021,268 | A * | 2/1962 | Egami | 205/359 |
| 4,487,677 | A | 12/1984 | Murphy | |
| 4,518,426 | A * | 5/1985 | Murphy | 75/619 |
| 4,783,326 | A * | 11/1988 | Srednicki | 423/243.03 |
| 6,942,715 | B2 | 9/2005 | Ito et al. | |
| 2003/0145682 | A1 * | 8/2003 | Anderson et al. | 75/364 |

OTHER PUBLICATIONS

Material Safety Data Sheet for Titanium tetrachloride. Sigma-Aldrich. Updated Feb. 20, 2008. Printed Apr. 6, 2009.*

Noyes, Robert, Unit Operations in Environmental Engineering, pp. 94-101. (10 pages total, including front matter), 1994.*

* cited by examiner

*Primary Examiner* — Scott Kastler
*Assistant Examiner* — Vanessa Velasquez
(74) *Attorney, Agent, or Firm* — Mark A. Garzia, Esq.; Law Offices of Mark A. Garzia, P.C.

(57) ABSTRACT

A process for producing titanium metal sponge from an exothermic reaction between titanium tetrachloride vapor and molten magnesium vapor, and reclaiming reactive metals from by-products of the exothermic reaction.

23 Claims, 4 Drawing Sheets

TITANIUM PRODUCTION PROCESS PREFERRED EMBODIMENT

PROCESS FOR RECOVERING TITANIUM

FIELD OF THE INVENTION

This invention relates generally to processes for recovering titanium and, more particularly, to a process for producing titanium metal sponge employing an exothermic reaction in a single reaction shell (vessel) between titanium tetrachloride vapor and molten magnesium vapor or sodium vapor producing, respectively, magnesium chloride, sodium chloride, and titanium metal sponge.

BACKGROUND OF THE INVENTION

The two processes most widely used for producing titanium are the Kroll process and the Hunter process.

The Kroll process reacts titanium tetrachloride, $TiCl_4$ with molten magnesium, Mg, to produce titanium metal in an inert atmosphere, usually argon, by the reaction:

$$2Mg+TiCl_4 \rightarrow Ti+2MgCl_2$$

The Hunter process reacts titanium tetrachloride with molten sodium, Na, to produce titanium metal in an inert atmosphere, usually argon, by the reaction:

$$4Na+TiCl_4 \rightarrow Ti+4NaCl$$

Considering the atomic masses of magnesium, sodium, and titanium, the reaction equations indicate that one pound (lb.) of magnesium or 1.9 pounds (lbs.) of sodium will produce one pound of titanium. Experience has shown, however, that required magnesium and sodium quantities are 10-to-15% greater than the reaction equations suggest.

Current commercial production facilities produce titanium sponge by either the Kroll or the Hunter process. The two processes are not simultaneously or sequentially used in the same reaction vessel to produce titanium.

The reaction vessels used do not contain electrolysis cells enabling reclamation and reuse of either magnesium chloride or sodium chloride. The magnesium chloride $MgCl_2$ and sodium chloride NaCl byproducts produced by the two processes are pumped out of the reaction vessel and transported to another site to reclaim magnesium and sodium, usually by electrolysis. The handling of molten magnesium chloride and molten sodium chloride and transportation to a remote site present technical problems which have associated costs.

U.S. Pat. Nos. 4,487,677 and 4,516,426 describe a process and equipment for production of titanium sponge which separates the magnesium chloride from the titanium immediately following the Kroll process reaction and returns the magnesium chloride to the electrolyte in an electrolysis cell inside the same reaction vessel to enable magnesium production for a succeeding Kroll process reaction.

The process described in U.S. Pat. No. 4,516,426 eliminates the need to transport magnesium chloride or sodium chloride byproducts of the Kroll and Hunter process reactions to a remote facility for reclamation of magnesium or sodium, providing potential for considerable economic benefit. Other process characteristics, however, reduce the efficiency of the process and equipment described in U.S. Pat. Nos. 4,487,677 and 4,516,426.

The electrolyte used for magnesium production is magnesium chloride; no other salts are added. This compound has a relatively high melting point of approximately 1317° F. making it necessary to operate the electrolysis cell at high temperature with concomitant short refractory life. Molten magnesium chloride has relatively low electrical conductivity, causing generation of much waste heat during electrolysis, increasing the cost of magnesium recovery.

In the process disclosed in the aforementioned patents, a fixed amount of liquid titanium tetrachloride periodically is injected into a container holding molten magnesium. This procedure did not adequately control the Kroll process reaction. Contact of liquid titanium tetrachloride which has a boiling point of 278° F. (136.4° C.) with liquid magnesium at temperatures of 1300-to-1400° F. (704-to-760° C.) followed by a highly exothermic reaction could generate high gas turbulence in the product container, blowing the magnesium pool out of the open lower end of the product container submerged in the electrolyte, preventing further titanium tetrachloride-magnesium reaction.

Very small amounts of chlorine containing more than 200 ppm water may contact steel surfaces during salt electrolysis, producing iron chloride, $FeCl_2$. Since the compound has a melting point of approximately 1240° F., liquid iron chloride could drop into the electrolyte. Iron chloride has a lower negative free energy than magnesium chloride. Consequently, the electrolysis cell would produce iron instead of magnesium until the iron chloride had been consumed.

The container holding the titanium product produced by the Kroll process is made of graphite. Titanium carbide forms during the exothermic reaction, bonding the titanium to the product container and making titanium separation without breaking the container difficult, thus adding to the cost and difficulty of producing titanium.

U.S. Pat. No. 6,942,715 describes stirring methods to increase the efficiency of the reaction of titanium tetrachloride and magnesium in producing titanium by the Kroll process. Stirring is not used to enable this reaction in the process herein described.

SUMMARY OF THE INVENTION

Unlike current commercial processes for producing titanium sponge, the present invention does not pump out magnesium chloride or sodium chloride from the reaction vessel or transport either compound to a remote facility for reclamation of magnesium and sodium. Magnesium chloride and sodium chloride byproducts of the Kroll and Hunter processes are immediately separated from the titanium produced and electrolyzed by an electrolysis cell in the reaction vessel to reclaim magnesium and sodium for reuse.

In contrast with U.S. Pat. No. 6,942,715, stirring is not used to enable this reaction in the process herein described.

BRIEF DESCRIPTION OF THE DRAWINGS

The accompanying drawings, which are incorporated in and form a part of the specification, illustrate the embodiments of the present invention and, together with the following description, serve to explain the principles of the invention. For the purpose of illustrating the invention, there are shown in the drawings embodiments which are presently preferred, it being understood, however, that the invention is not limited to the specific instrumentality or the precise arrangement of elements or process steps disclosed.

In the drawings.

DETAILED DESCRIPTION OF THE PREFERRED EMBODIMENT

Figure 1:
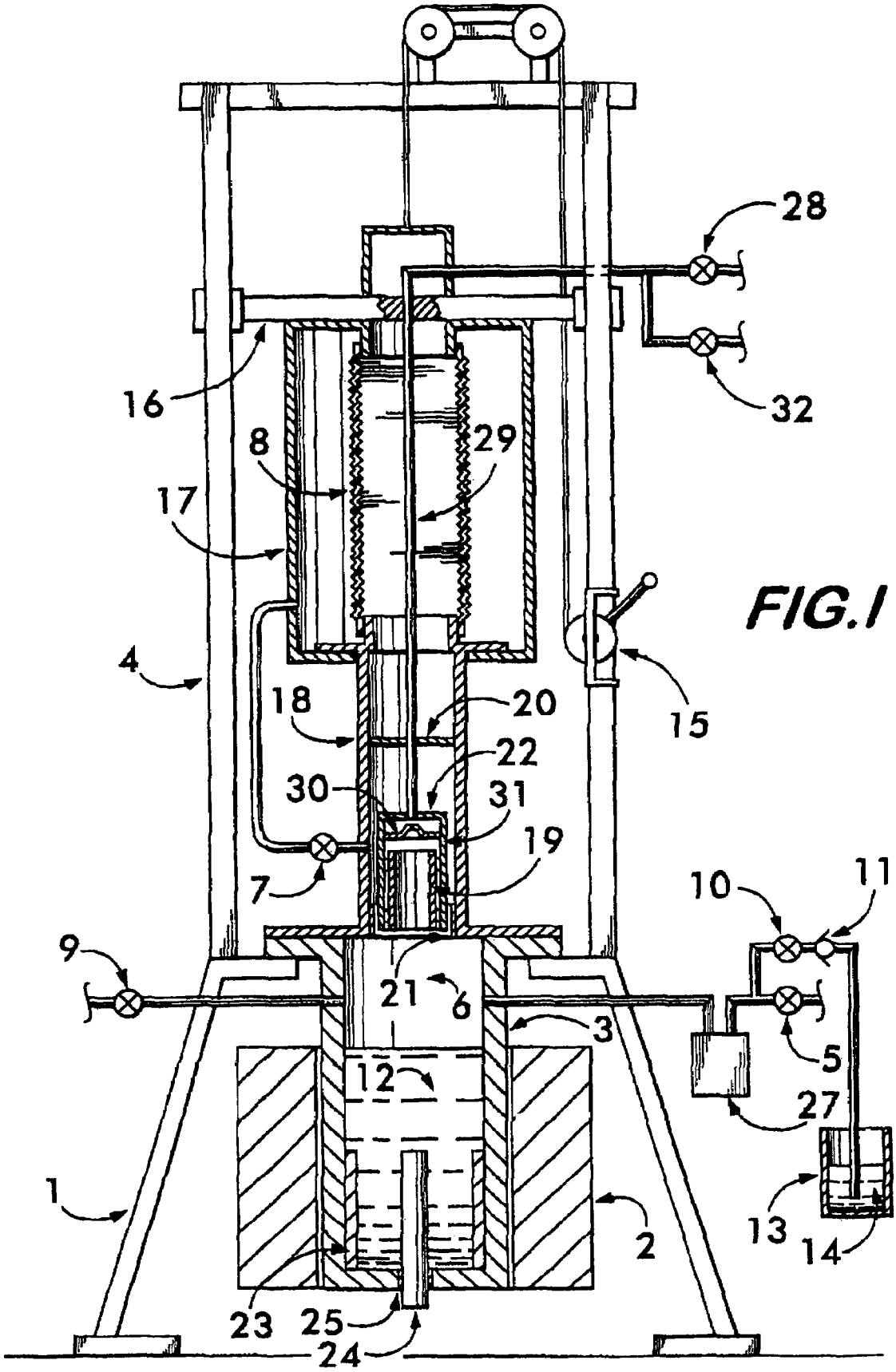
FIG. 1 is a front view of the titanium sponge production system in accordance with the present invention.

In describing a preferred embodiment of the invention, specific terminology will be selected for the sake of clarity. However, the invention is not intended to be limited to the specific terms so selected, and it is to be understood that each specific term includes all technical equivalents that operate in a similar manner to accomplish a similar purpose.

Preferred embodiments of the present invention will now be described in detail with reference to the accompanying drawings. The process, in accordance with present invention, and its associated use is disclosed below.

U.S. Pat. Nos. 4,487,677; 4,516,426; and 6,942,715 are incorporated by reference as if fully set forth herein.

Electrolyte Description

The reactor shell contains an electrolysis cell in its base and a molten salt mixture of three or more salts. One of the salts is magnesium chloride ($MgCl_2$). The Gibbs free energy (negative free energy) of the $MgCl_2$ is lower than that of the other salt mix components. Consequently, $MgCl_2$ will electrolyze before the other salts electrolyze.

The salt mix chosen has the following physical properties:

Relatively high electrical conductivity.

Low melting point.

Higher density than liquid magnesium to enable magnesium to float on the salt mix surface.

High concentration of magnesium chloride.

A preferred embodiment of a salt mix is 20%-to-40% magnesium chloride (concentration 0.2 to 0.4) containing a maximum water content of 2%, 30%-to-50% sodium chloride, and 10%-to-20% barium chloride. Minimization of water content inhibits formation of magnesium oxide, which increases the viscosity of the electrolyte and may form an insulating film on the cathode.

During electrolysis, magnesium chloride concentration is allowed to drop from 0.40 to 0.10 if titanium sponge is to be produced by use of the Kroll process, only.

Magnesium chloride concentration is allowed to drop below 0.10 if titanium sponge is to be produced by sequential use of the Kroll and Hunter processes. In such event, sodium chloride electrolysis will begin when magnesium chloride concentration drops to 0.07-to-0.08. Since the density of sodium is less than that of magnesium, a sodium pool will form on top of the magnesium pool and titanium will be produced by the Hunter process before the metal is produced by the Kroll process. The publication titled *Electrolytic Production of Magnesium*—Kh. L. Strelets, U.S. Dept. of Commerce Report No. TT 76-50003, pps. 226-227, describes the co-production of magnesium and sodium when magnesium chloride concentration is in the 0.07-to-0.08 range.

Commercial magnesium producers do not use salt mixes containing a high concentration of magnesium chloride which then is allowed to drop to 0.07-to-0.08 during electrolysis because salt mixes containing high concentrations of magnesium chloride have relatively low electrical conductivity increasing energy cost per unit of magnesium produced. The allowable upper magnesium chloride concentration limit ranges from 0.15 to 0.18.

Once a determination has been made of optimum magnesium chloride concentration during electrolysis, magnesium chloride is added to the electrolyte to maintain this concentration as magnesium is harvested.

The increased energy cost in electrolyzing a salt mix containing a high concentration of magnesium chloride is more than offset by the savings attained by in situ electrolysis of the magnesium chloride byproduct generated during use of the Kroll process.

Precipitation of Salt Particles from the Chlorine Gas Stream during Electrolysis The liquid salt mixes used have a high vapor pressure. Consequently, the chlorine gas stream generated during salt electrolysis contains a significant amount of salt vapor. This vapor solidifies and agglomerates when it passes into valves and orifices which are near ambient temperature, forcing a shutdown of the electrolysis cell.

This problem is overcome by insertion of a heat exchanger and condenser between the electrolysis cell and the first control valve. Cooling the gas stream causes precipitation of salt vapor from the chlorine stream. The precipitate is collected in a trap which is periodically cleaned.

Titanium Tetrachloride Flow Control and Gassification—Delivery System

Kroll and Hunter process reaction turbulence is minimized by control of titanium tetrachloride droplet size, discharge rate, and gasification of the liquid before it enters the reaction zone.

Droplet size and discharge rate are controlled by use of a titanium tetrachloride pumping system which maintains a 10 psig pressure against a solenoid valve, an "On-Off" interval timer, and a cycle timer. Valve opening and closing time and repeat rate can be adjusted to 10 millisecond accuracy.

Gasification is accomplished by discharge of liquid titanium tetrachloride onto a heated cone before the compound contacts the magnesium or sodium vapor above the magnesium or sodium pool, enabling a vapor-to-vapor reaction between titanium tetrachloride gas and magnesium gas above the liquid magnesium pool.

Use of a Titanium Container for Sponge Production

Commercial reaction vessels, which contain the titanium sponge produced by either Kroll or Hunter process reactions, are made of steel. The sponge reacts with the steel to produce a layer of ferrotitanium between the sponge and the steel.

Since iron content in commercial grade titanium cannot exceed 0.10%, care must be taken in separating the sponge that is produced from the ferrotitanium.

Use of a titanium product container prevents ferrotitanium formation and need for use of separation procedures.

Wet Chlorine Control Components

Technical grade anhydrous magnesium chloride may contain up to 2% water. Consequently, chlorine produced during electrolysis will contain more than 200 ppm water. This "wet" chlorine will react with iron at elevated temperatures to form iron chloride. Since presence of this compound pollutes the electrolyte and prevents either magnesium or sodium production by electrolysis, it is mandatory that wet chlorine produced during electrolysis not contact any steel surfaces.

Hot chlorine also will react with the titanium product container to form titanium tetrachloride, dissolving the container.

Chlorine reaction with steel reaction vessel components is prevented by plasma spraying all such components with nickel-base alloys which are compatible with wet chlorine.

Chlorine reaction with the titanium product container is prevented by placement of the product container inside a graphite tube whose Darcy coefficient of permeability has been reduced by graphite manufacturer's use of a proprietary impregnation process.

Preparation for Salt Heating

Referring now to FIG. 1. The various components of and their respective position of a titanium sponge production system at the start of a titanium production cycle is shown. All components are at room temperature.

Heating Frame 1 supports the Electrical Resistance Furnace 2, Reactor Shell 3, and the Superstructure 4 which houses all other components of the titanium production system.

Vacuum Valve 5 is opened to connect a vacuum pumping system to the Reactor Shell Plenum 6. Vacuum Valve 7 is opened to equalize pressure on inside and outside of Bellows 8 during pumpdown. The plenum is pumped down to 150-to-500 millitorr in a preferred embodiment of the invention.

Vacuum Valve 5 is closed. Argon Valve 9 is opened to connect the plenum to an argon source. The plenum is backfilled with argon and pressurized to 2-to-3 psig. Argon Valve 9 is closed. Chlorine Control Valve 10 is opened to connect Reactor Shell Plenum 6 to Check Valve 11 which has a 5 psig cracking pressure.

Salt Heating

Electric Resistance Furnace 2 heats Reactor Shell 3 and Salt Mix 12 to 1450-1600° F. As the temperature increases, any water of hydration held by the magnesium chloride component of the salt mix ultimately enters into the reaction $$MgCl_2.H_2O \rightarrow MgO+2HCl$$

When the pressure reaches 5 psig, Check Valve 11 opens allowing discharge of argon and hydrochloric acid gas into Tank 13 containing a 15% Sodium Hydroxide Solution, NaOH 14. The argon component bubbles through the sodium hydroxide to atmosphere. The hydrochloric acid gas component enters into the reaction $$HCl+NaOH \rightarrow NaCl+H_2O$$

neutralizing the hydrochloric acid.

Salt Electrolysis

Figure 2:
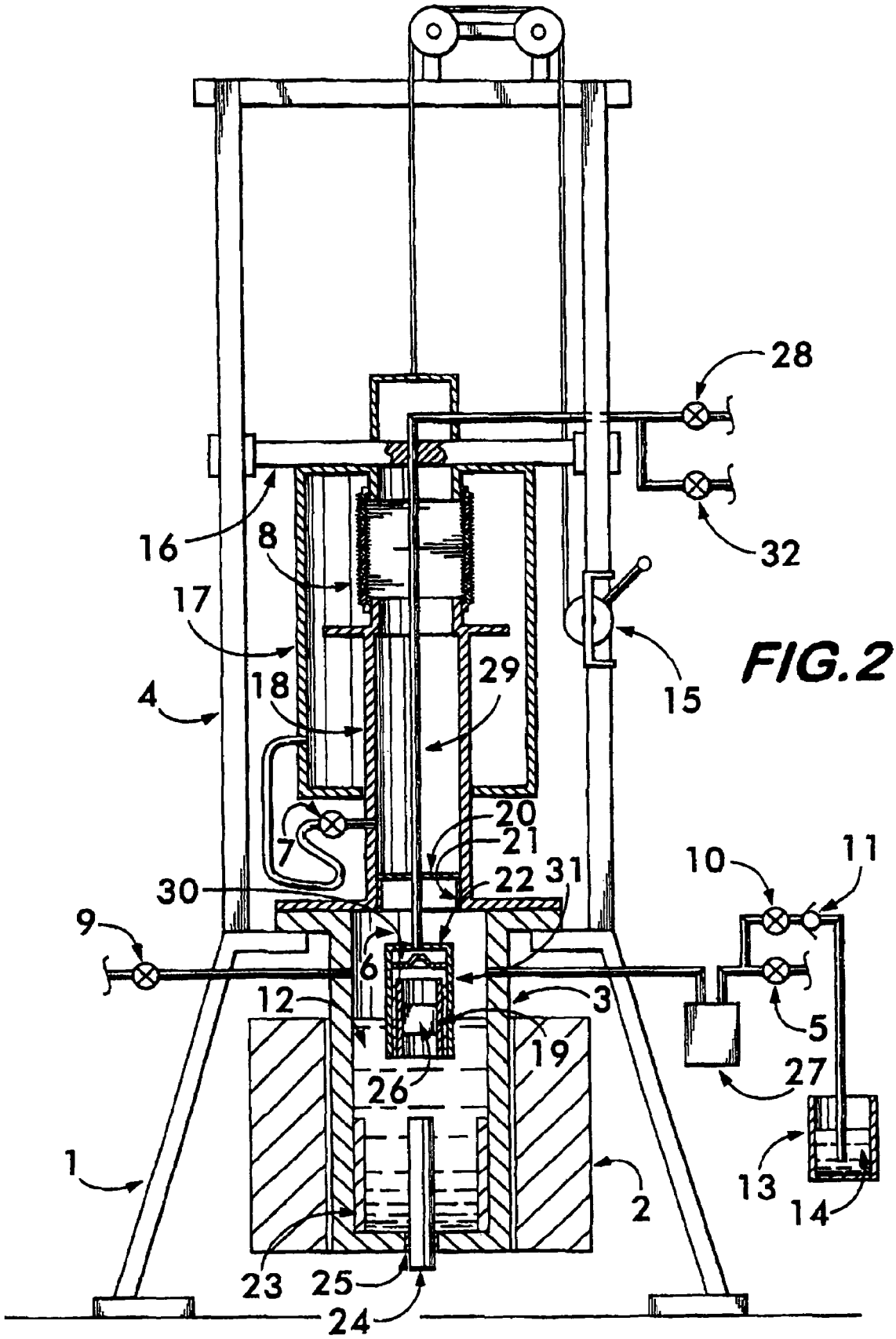
FIG. 2 is a front view of the titanium sponge production system of FIG. 1 during the salt electrolysis step, and the titanium production step.

Referring now to FIG. 2, Close Vacuum Valve 7. Winch 15 lowers Platen 16. Vacuum Enclosure 17 moves downward breaking seal between Vacuum Enclosure 17 and Product Container Enclosure 18. Bellows 8 is compressed. Its internal pressure now is 5 psig. Titanium Product Container 19 is lowered to a position to accept magnesium produced by salt electrolysis. Stop Valve 20 contacts Stop Tube 21 preventing wet chlorine flow to steel surfaces above Stop Valve 20. The graphite Product Container Protection Tube 22, sealed by the graphite producer to prevent chlorine seepage, protects Titanium Product Container 19 from chlorine attack.

A DC power supply is connected to Anode 23 and Cathode 24 whose electrical isolation is maintained by Mica Insulator 25, and started to electrolyze the magnesium chloride component of the salt mix between the electrodes. The DC power supply is preferably rated at 3000 amperes, 6-to-18 VDC.

Magnesium ions move to the cathode; chlorine ions move to the anode.

Liquid magnesium rises from the cathode into the Product Container to form Magnesium Pool 26. Salt vapor in the chlorine is precipitated by Heat Exchanger 27. The chlorine either may be stored and sold as electrolytic grade chlorine or pass through Chlorine Control Valve 10 and Check Valve 11 into the Sodium Hydroxide Solution 14 to be neutralized. Reaction of sodium hydroxide and chlorine produces hypochlorite (NaOCl—bleach).

Continuation of electrolysis after magnesium chloride concentration in the electrolyte has dropped below 0.08 produces sodium, floating on top of the magnesium since density of sodium is less than that of magnesium.

The amount of metal produced by electrolysis is determined by a probe sensing salt mix height and also by integration of chlorine mass flow rate readings. When the desired amount of reactant metal has been produced, the electrolysis power supply is shut down.

Production of Titanium Metal

The Titanium Tetrachloride Pumping System is actuated to apply a constant 10-to-15 psig pressure on Solenoid Valve 28. One Interval Timer and one Cycle Timer are adjusted to control operation of Solenoid Valve 28 to optimize droplet size and number of droplets discharged per minute. Liquid titanium tetrachloride passes through Tickle Feed Tube 29 and falls onto heated Gasifier Cone 30 vaporizing the liquid. (It should be noted that a flat Gasifier plate or disk may be used instead of Gasifier Cone 30. However, in the preferred embodiment, it was found that a Gasifier Cone 30 was more efficient since it has a greater surface area than a disk of the same diameter.)

Graphite Seal 31 constrains titanium tetrachloride gas to fill the plenum in Titanium Product Container 19, reacting with the sodium or magnesium vapor above the metal pool and the pool surface. Titanium sponge deposits on the inside surface of the Titanium Product Container 19. Liquid sodium chloride and/or magnesium chloride reaction byproducts sink into the electrolyte enabling electrolysis recycling.

Retrieval of Titanium Sponge from the Titanium Product Container

Continuing to refer to FIG. 2, Argon Valve 9 is opened. Argon flows through the Reactor Shell Plenum 6, through Chlorine Control Valve 10 and Check Valve 11 purging the plenum of chlorine. Argon Valve 9 is closed after purging.

Referring again to FIG. 2, the Platen 16 is raised by Winch 15. The Product Container Protection Tube 22 and the Titanium Product Container 19 are lifted out of the liquid salt mix to the position shown in FIG. 1. Stop Valve 20 is lifted off Stop Tube 21.

Argon pressure is set at 3 psig. Argon Valve 9 is opened. Argon flows through the Reactor Shell Plenum 6 but is not discharged because Check Valve 11 cracking pressure is 5 psig. Argon pressure is maintained until internal temperatures are below 130° F. to prevent a vacuum from developing during cooling.

Close Argon Valve 9. Open Oxygen Metering Valve 32. Set flow rate at 1 standard cubic foot per hour. Oxygen will passivate the surface of the titanium sponge produced, preventing an exothermic reaction when the reaction vessel is opened to air.

Referring again to FIG. 2, the Product Container Enclosure 18 is disconnected from Reactor Shell 3.

Figure 3:
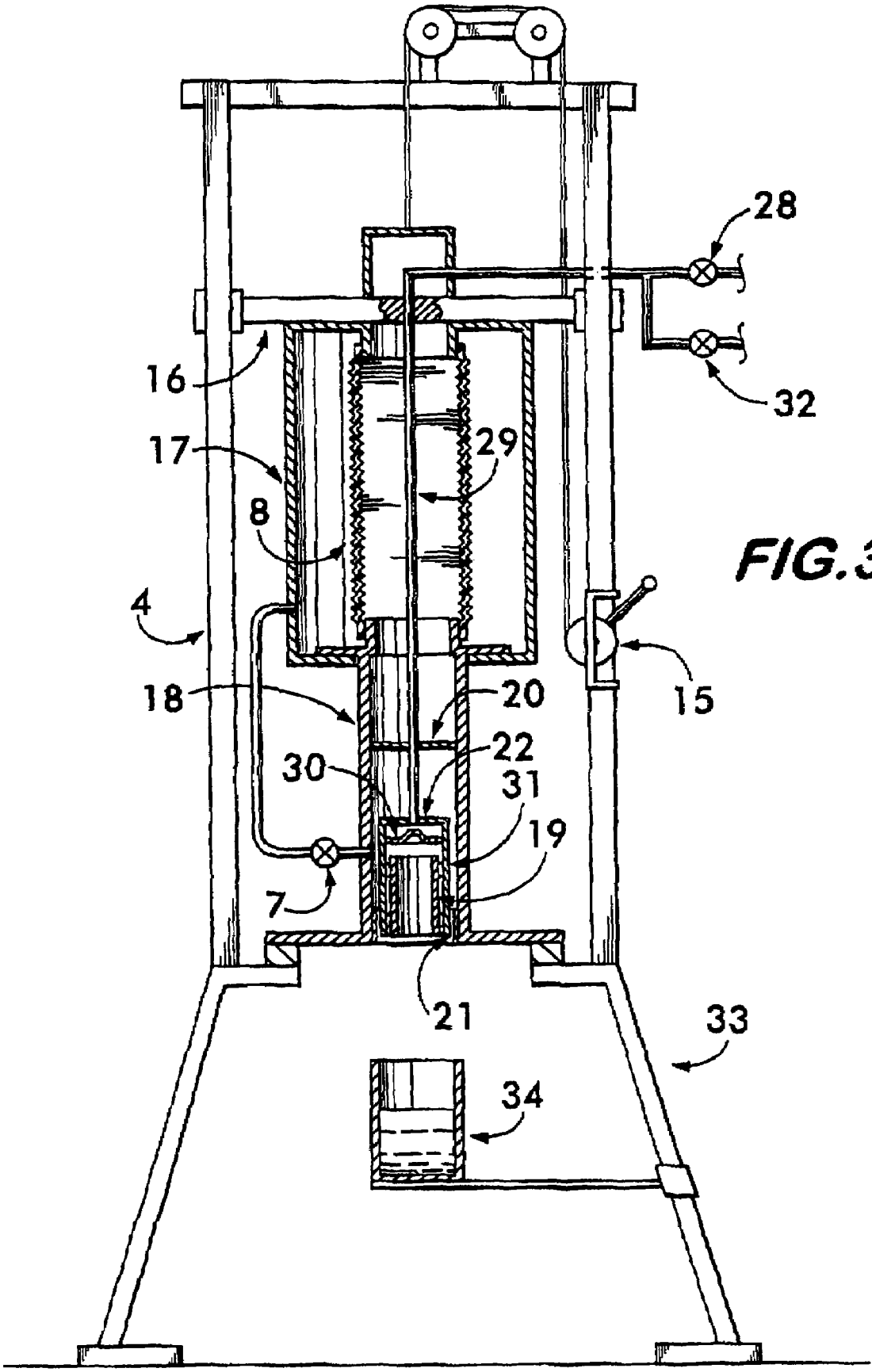
FIG. 3 is a front view of the titanium sponge production system showing the Product Container Enclosure being removed from the Reactor Shell and placed on a cup-holding frame in anticipation of receiving the Titanium Product Container.
Figure 4:
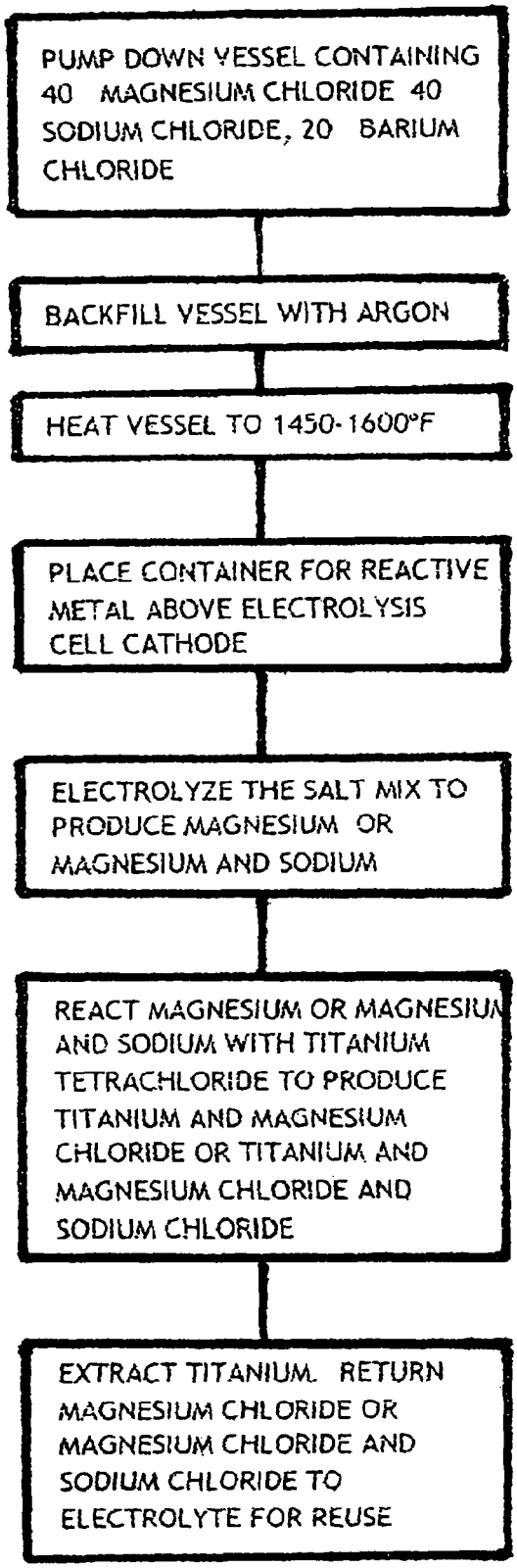
FIG. 4 is a block diagram of the process steps used to produce the titanium metal sponge in accordance with the preferred embodiment of the present invention.

Referring now to FIG. 3, superstructure 4 is removed from Heating Frame 1 and placed onto Retrieval Frame 33 shown on FIG. 3. Referring to FIG. 3, Winch 15 lowers the Product Container Protection Tube 22 and its contents into Cup 34. The Product Container Protection Tube 22 is disconnected from Tickle Feed Tube 29. The Titanium Product Container 19 is removed from the Product Container Protection Tube 22. The titanium sponge is removed from the Titanium Product Container 19 using tooling designed to minimize removal of titanium from the I.D. of the Titanium Product Container 19.

Although this invention has been described and illustrated by reference to specific embodiments, it will be apparent to those skilled in the art that various changes and modifications may be made which clearly fall within the scope of this invention. The present invention is intended to be protected broadly within the spirit and scope of the appended claims.

I claim:

1. A process for producing titanium sponge in a stepwise operation within a closed cell system, comprising the steps of:

a) providing a salt mixture of two or more salts that includes at least magnesium chloride and sodium chloride;

b) heating said salt mixture to a molten state;

c) electrolytically decomposing said molten salt mixture into molten metallic layers which have a lower specific gravity than said molten salt mixture and float upon said molten salt mixture layer; and d) introducing gaseous titanium tetrachloride from above said decomposed layers which allows the gaseous titanium tetrachloride to react with vapor given off from said molten metallic layers and also allows the gaseous titanium tetrachloride to react directly with the highest molten metallic layer forming titanium sponge and a salt, whereby the molten metallic layer is at first comprised of sodium until the reaction of titanium tetrachloride with sodium depletes the sodium and exposes a second metallic layer of magnesium to reaction with titanium tetrachloride.

2. The process of claim 1 where the salt mixture further comprises barium chloride.

3. The process of claim 1 where the air within the closed cell system is evacuated prior to heating said salt mixture to a molten state.

4. The process of claim 3 further comprising the step of filling the closed cell system with argon prior to heating said salt mixture to a molten state.

5. The process of claim 1 further comprising the step of controlling the amount of gaseous titanium tetrachloride delivered.

6. A process for producing titanium sponge in a stepwise operation within a closed cell system, comprising the steps of:

a) providing a salt mixture of two or more salts, wherein one of said two or more salts is magnesium chloride and the other of said two or more salts is sodium chloride;

b) heating said salt mixture to a molten state;

c) electrolytically decomposing said molten salt mixture into at least one molten metallic layer which has a lower specific gravity than said molten salt mixture and floats upon said molten salt mixture layer;

d) providing a titanium tetrachloride delivery system that can control the droplet size and feed rate of liquid titanium tetrachloride;

e) providing a heated surface capable of reaching a temperature that boils titanium tetrachloride;

f) discharging liquid titanium tetrachloride from the delivery system at a desired droplet size and feed rate onto said heated surface until it converts into a gaseous state; and g) introducing said gaseous titanium tetrachloride from above to said at least one decomposed layer which reacts with vapor given off from said at least one molten metallic layer and also reacts directly with said at least one molten metallic layer forming titanium sponge and a salt.

7. The process of claim 1 where the initial concentration of magnesium chloride in the salt mixture by mass is above 18 percent.

8. The process of claim 1 where the salt mixture comprises at least three salts including said magnesium chloride, said sodium chloride, and barium chloride.

9. The process of claim 1 where the salt mixture contains additional metal chlorides whose negative free energy is greater than that of magnesium chloride or sodium chloride.

10. The process of claim 1 whereby the chlorine produced from the electrolysis of a metal chloride is neutralized.

11. The process of claim 1 further comprising the step of recovering the chlorine produced from the electrolysis of a metal chloride said chlorine being of electrolytic grade is.

12. The process of claim 1 whereby a chlorine stream is produced from the electrolysis of the salt mixture, further comprising the steps of cooling said chlorine stream to precipitate, and removing from the chlorine stream any salt vapor contained in the chlorine stream.

13. The process of claim 1 where the air within the closed cell system is evacuated prior to heating said salt mixture to a molten state.

14. The process of claim 13 further comprising the step of filling the closed cell system with argon prior to heating said salt mixture to a molten state.

15. The process of claim 1 wherein the electrolytic decomposition is effected using a graphite anode and a steel cathode.

16. The process of claim 1 wherein the salt mixture is heated to a temperature of 1450-1600° F.

17. A process for producing titanium sponge in a stepwise operation within a closed cell system, comprising the steps of:

a) providing a salt mixture of two or more salts, that includes at least magnesium chloride and sodium chloride;

b) heating said salt mixture to a molten state;

c) electrolytically decomposing said molten salt mixture into molten metallic layers which have a lower specific gravity than said molten salt mixture and float upon said molten salt mixture layer;

d) providing a titanium tetrachloride delivery system that can control the droplet size and feed rate of liquid titanium tetrachloride, said delivery system including a reservoir of liquid titanium tetrachloride, a pump, a solenoid valve, a control/timing circuit and a titanium tetrachloride delivery means;

said pump capable of delivering the liquid titanium tetrachloride from said reservoir to the solenoid valve; said control/timing circuit for controlling the pump in order to maintain a desired pressure against the solenoid valve, and for opening and closing said solenoid valve at selectable intervals to the delivery means;

e) discharging liquid titanium tetrachloride from the delivery means at a desired droplet size and feed rate onto a heated surface until it converts into a gaseous state; and f) introducing said gaseous titanium tetrachloride above the surface of said decomposed layers which allows the gaseous titanium tetrachloride to react with vapor given off from said molten metallic layers and also allows the gaseous titanium tetrachloride to react directly with the topmost molten metallic layer forming titanium sponge and a salt, whereby the molten metallic layer is at first comprised of sodium until the reaction of titanium tetrachloride with sodium depletes the sodium and exposes a second metallic layer of magnesium to reaction with titanium tetrachloride.

18. The process of claim 17 wherein the control/timing circuit is adjusted so that the pump maintains about a 10 psig pressure against the valve.

19. The process of claim 17 wherein the control/timing circuit can adjust the open and close duration time of the solenoid valve at 10 millisecond intervals.

20. The process of claim 17 where the salt mixture further comprises barium chloride.

21. The process of claim 17 further comprising the step of providing a titanium product container to collect the titanium sponge.

22. The process of claim 17 further comprising the step of providing a titanium product container to collect the titanium sponge, said titanium product container being encased within an impregnated graphite tube that reduces the Darcy coefficient of permeability to protect the titanium container from reacting with wet chlorine that is produced as a by-product from the electrolysis step.

23. The process of claim 17 wherein said heated surface is cone-shaped.

* * * * *